US010327563B2

(12) United States Patent
Ocegueda Gallaga et al.

(10) Patent No.: US 10,327,563 B2
(45) Date of Patent: Jun. 25, 2019

(54) SYSTEMS AND METHODS FOR INTERNAL AIRBED STRUCTURE

(71) Applicant: POLYGROUP MACAU LIMITED (BVI), Road Town, Tortola (VG)

(72) Inventors: Victor Hugo Ocegueda Gallaga, Baja California (MX); Chaolong Lan, Shenzhen (CN); Minglian Ma, Shenzhen (CN)

(73) Assignee: POLYGROUP MACAU LIMITED (BVI), Road Town (VG)

( * ) Notice: Subject to any disclaimer, the term of this patent is extended or adjusted under 35 U.S.C. 154(b) by 430 days.

(21) Appl. No.: 15/147,625

(22) Filed: May 5, 2016

(65) Prior Publication Data

US 2016/0331148 A1 Nov. 17, 2016

Related U.S. Application Data

(60) Provisional application No. 62/159,564, filed on May 11, 2015, provisional application No. 62/322,560, filed on Apr. 14, 2016.

(51) Int. Cl.
*A47C 27/08* (2006.01)

(52) U.S. Cl.
CPC ..... *A47C 27/087* (2013.01)

(58) Field of Classification Search
CPC ..... A47C 27/087; A47C 27/08
USPC ..... 5/706, 710–712
See application file for complete search history.

(56) References Cited

U.S. PATENT DOCUMENTS

| | | | | |
|---|---|---|---|---|
| 379,827 | A | 3/1888 | Snavely et al. | |
| 1,916,483 | A * | 7/1933 | Krichbaum | A47C 27/081 2/88 |
| 2,887,692 | A | 5/1959 | Gosman | |
| 3,251,075 | A | 5/1966 | Saltness et al. | |
| 4,181,990 | A | 1/1980 | Santo | |
| 4,349,926 | A | 9/1982 | Winther | |
| 4,541,135 | A | 9/1985 | Karpov | |
| 4,644,597 | A | 2/1987 | Walker | |
| 4,700,419 | A | 10/1987 | Santo | |
| 4,941,223 | A | 7/1990 | Santo | |
| 5,452,487 | A | 9/1995 | Leggett | |
| 5,535,463 | A | 7/1996 | Chiu | |

(Continued)

FOREIGN PATENT DOCUMENTS

| | | | |
|---|---|---|---|
| CN | 2930467 | Y | 8/2007 |
| CN | 201019353 | Y | 2/2008 |

(Continued)

OTHER PUBLICATIONS

Office Action from related U.S. Appl. No. 15/184,360, dated Jun. 29, 2017.

(Continued)

*Primary Examiner* — Fredrick C Conley
(74) *Attorney, Agent, or Firm* — Troutman Sanders LLP; Ryan A. Schneider; Christopher C. Close, Jr.

(57) ABSTRACT

An air mattress comprises an internal structure for helping the air mattress maintain a desired geometric shape when inflated and for preventing shearing of the top and bottom surfaces of the mattress. The internal structure comprises a plurality of connection strips or a mesh web that are attached to a plurality of top surface connection points and bottom surface connection points.

19 Claims, 8 Drawing Sheets

(56) References Cited

U.S. PATENT DOCUMENTS

| | | | | |
|---|---|---|---|---|
| 5,598,593 | A | 2/1997 | Wolfe | |
| 6,088,859 | A | 7/2000 | Cavazos | |
| 6,568,013 | B2 | 5/2003 | Perez et al. | |
| 7,089,618 | B1 | 8/2006 | Metzger | |
| 7,363,970 | B2 | 4/2008 | Corre et al. | |
| 7,478,448 | B2 | 1/2009 | Boso et al. | |
| 7,610,642 | B2 | 11/2009 | Boyd | |
| 8,562,773 | B2 | 10/2013 | Lin et al. | |
| 9,156,203 | B2 | 10/2015 | Lin et al. | |
| 9,247,827 | B2 | 2/2016 | Lin et al. | |
| 2009/0165211 | A1 | 7/2009 | Song et al. | |
| 2013/0228268 | A1 | 9/2013 | Lin et al. | |
| 2013/0230670 | A1 | 9/2013 | Lin et al. | |
| 2013/0230671 | A1 | 9/2013 | Lin et al. | |
| 2014/0265485 | A1 | 9/2014 | Wang et al. | |
| 2014/0332139 | A1 | 11/2014 | Lin et al. | |
| 2014/0332142 | A1 | 11/2014 | Lin et al. | |
| 2015/0096126 | A1* | 4/2015 | Chai ..... | A47C 27/081 5/706 |
| 2015/0113736 | A1 | 4/2015 | Cox et al. | |
| 2015/0201760 | A1 | 7/2015 | Lin et al. | |
| 2015/0335164 | A1 | 11/2015 | Liu | |

FOREIGN PATENT DOCUMENTS

| | | | |
|---|---|---|---|
| CN | 201032956 | Y | 3/2008 |
| CN | 201599174 | U | 10/2010 |
| CN | 202243135 | U | 5/2012 |
| CN | 102578859 | A | 7/2012 |
| CN | 102578860 | A | 7/2012 |
| CN | 102602598 | A | 7/2012 |
| CN | 202536548 | U | 11/2012 |
| CN | 202536827 | U | 11/2012 |
| CN | 102990929 | A | 3/2013 |
| CN | 103110297 | A | 5/2013 |
| CN | 202919638 | U | 5/2013 |
| CN | 203137718 | U | 8/2013 |
| CN | 203137719 | U | 8/2013 |
| CN | 203296407 | U | 11/2013 |
| CN | 103600502 | A | 2/2014 |
| CN | 204218433 | U | 3/2014 |
| CN | 203735815 | U | 7/2014 |
| CN | 203852092 | U | 10/2014 |
| CN | 204232695 | U | 4/2015 |
| CN | 204599945 | U | 9/2015 |
| CN | 303354844 | S | 9/2015 |
| DE | 472078 | C | 2/1929 |
| DE | 102010022957 | A1 | 12/2011 |
| FR | 1414259 | A | 10/1965 |
| WO | 2013130117 | A1 | 9/2013 |

OTHER PUBLICATIONS

NPL Design U.S. Appl. No. 29/502,063, filed Sep. 11, 2014, entitled Inflatable Mattress, Allowed Apr. 27, 2016.

EP Extended Search Report from related EP Application No. 16196895.3, dated Sep. 7, 2017,10 pp.

* cited by examiner

SYSTEMS AND METHODS FOR INTERNAL AIRBED STRUCTURE

CROSS-REFERENCE TO RELATED APPLICATIONS

This application claims the benefit under 35 U.S.C. § 119(e) of U.S. Provisional Patent Application No. 62/159,564, filed 11 May 2015, and U.S. Provisional Patent Application No. 62/322,560, filed 14 Apr. 2016, the entire contents and substance of which are hereby incorporated by reference as if fully set forth below.

FIELD OF THE INVENTION

The presently disclosed subject matter relates generally to airbed systems, particularly internal tensioning structures for airbeds.

BACKGROUND

Conventional airbeds, or air mattresses, as they are commonly referred, are typically used in lieu of traditional box-spring mattresses, memory foam mattresses, water beds, and other beds as temporary structures for sleeping. Generally, air mattresses comprise a soft and flexible material chamber with an air-tight seal that allows the air mattress to inflate during use and deflate after use. While some air mattresses must be manually inflated by the human user, many air mattresses include a manual or an electric pump to enable mechanical inflation. Airbeds typically comprise an internal structure or tensioning structure that helps the airbed achieve its intended shape once the airbed is inflated. The internal structure also prevents the airbed from over-inflating. In some conventional airbeds, the internal structure comprises a plurality of strips with each strip comprising several strands of string or wire. In some cases, however, the internal structure can add to the airbed's overall weight and rigid components can make the airbed cumbersome to fold up and store when not inflated. And in other cases, the internal structure does not provide a desired appearance of the airbed.

Accordingly, there is a need for improved systems and methods to address the above mentioned deficiencies. Embodiments of the present disclosure are directed to these and other considerations.

SUMMARY

Briefly described, embodiments of the presently disclosed subject matter relate to airbed systems and, in particular, airbed systems having improved tensioning structures such as a sheet-based internal structure or strip-based internal structures.

Aspects of the present disclosure relate to internal structures for air mattresses. In particular, certain aspects of the present disclosure relate to an internal structure comprising a sheet connected to the interior surfaces of the top and bottom surfaces of an air mattress. According to some embodiments, the sheet may comprise a single piece of material have a plurality of apertures, forming a mesh (which may be referred to as a "mesh sheet" or "mesh web"). Each of the top and bottom surfaces may comprise a plurality of connection points, and the sheet may be attached to two or more top surface connection points and two or more bottom surface connection points. The sheet may be attached to the top surface and bottom surface in such a manner that it forms a web-like structure or a wavy 3-dimensional sinusoidal shape when the airbed is inflated. The internal structure may help the air mattress maintain its intended geometric shape when inflated. Further, the internal structure may prevent the air mattress from becoming over-inflated. Also, the internal structure may prevent the top and bottom surfaces of the air mattress from shearing (i.e., moving laterally relative to one another) when the air mattress is in use. Also, because such an internal structure is light-weight and adds little to the overall bulk of the air mattress, when deflated, the air mattress can be easily stowed away and transported.

Other embodiments of the present disclosure relate to internal structures comprising a plurality of connection strips or a mesh web connected to the interior surfaces of the top and bottom surfaces of an air mattress. Each of the top and bottom surfaces may comprise a plurality of connection points, and the connection strips or portions of the mesh web attach to the surfaces at those connection points. In some embodiments, multiple connection strips may attach to a single connection point. Further, connection strips may angle from one connection point on the bottom surface toward another connection point on the top surface. In such a configuration, the plurality of connection strips constitute an internal structure that is configured like a web. The web-like internal structure may help the air mattress maintain its intended geometric shape when inflated and provide other such benefits as described above with respect to the internal structure comprising a sheet The foregoing summarizes only a few aspects of the presently disclosed subject matter and is not intended to be reflective of the full scope of the presently disclosed subject matter as claimed. Additional features and advantages of the presently disclosed subject matter are set forth in the following description, may be apparent from the description, or may be learned by practicing the presently disclosed subject matter. Moreover, both the foregoing summary and following detailed description are exemplary and explanatory and are intended to provide further explanation of the presently disclosed subject matter as claimed.

BRIEF DESCRIPTION OF THE DRAWINGS

The accompanying drawings, which are incorporated in and constitute a part of this specification, illustrate multiple embodiments of the presently disclosed subject matter and, together with the description, serve to explain the principles of the presently disclosed subject matter; and, furthermore, are not intended in any manner to limit the scope of the presently disclosed subject matter.

DETAILED DESCRIPTION

Figure 1:
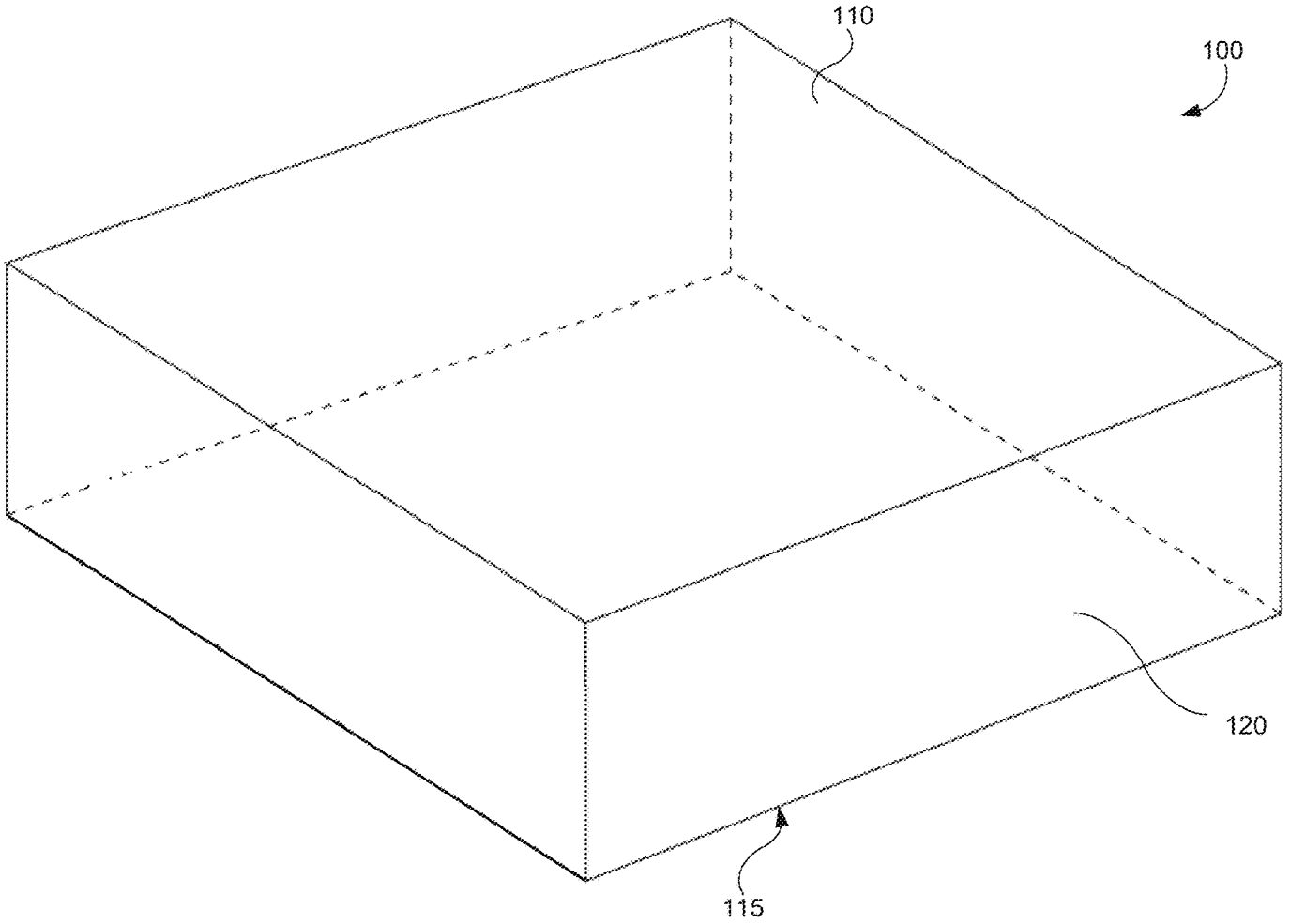
FIG. 1 is a schematic overview of an air mattress, in accordance with an example embodiment of the presently disclosed subject matter.

Although certain embodiments of the disclosure are explained in detail, it is to be understood that other embodiments are contemplated. Accordingly, it is not intended that the disclosure is limited in its scope to the details of construction and arrangement of components set forth in the following description or illustrated in the drawings. Other embodiments of the disclosure are capable of being practiced or carried out in various ways. Also, in describing the embodiments, specific terminology will be resorted to for the sake of clarity. It is intended that each term contemplates its broadest meaning as understood by those skilled in the art and includes all technical equivalents which operate in a similar manner to accomplish a similar purpose.

It should also be noted that, as used in the specification and the appended claims, the singular forms "a," "an" and "the" include plural references unless the context clearly dictates otherwise. References to a composition containing "a" constituent is intended to include other constituents in addition to the one named. Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

The present disclosure is described in reference to an internal structure for an air mattress or airbed. In particular, the present disclosure relates to an internal structure that comprises a sheet or a plurality of connection strips that attach to connection points on the top and bottom surfaces of an air mattress. In some embodiments, the sheet or connection strips may angle from one connection point (e.g., on the bottom surface) toward another connection point (e.g., on the top surface). A single sheet can be attached to a plurality of connection points, creating an internal structure having a web-like effect. Further, in some embodiments, multiple connection strips can attach to a single connection point, thus creating an internal structure having a web-like effect. An internal structure having such a web-like configuration not only helps the air mattress maintain its intended shape and prevents over-inflation, it prevents the top and bottom surfaces from shearing or moving laterally relative to one another. Further, because such an internal structure is light-weight and comprises minimal material, it allows the air mattress to be easily stowed and transported.

Referring now to the figures, wherein like reference numerals represent like parts throughout the views, embodiments of the internal airbed structure will be described in detail.

FIG. 1 is an overview of an air mattress 100. Air mattress 100 may vary in size once inflated based on the desired dimensions and/or number of users. For example, air mattress 100 may be a twin, full, queen, or king size bed. In some embodiments, air mattress 100 may be constructed out of polyvinyl chloride ("PVC"). It is contemplated, however, that other materials such as other plastics or rubber may be used. Further, as shown in FIG. 1, the air mattress 100 may comprise a top surface 110 and bottom surface 115 as well as side surfaces (e.g., side surface 120).

Figure 2:
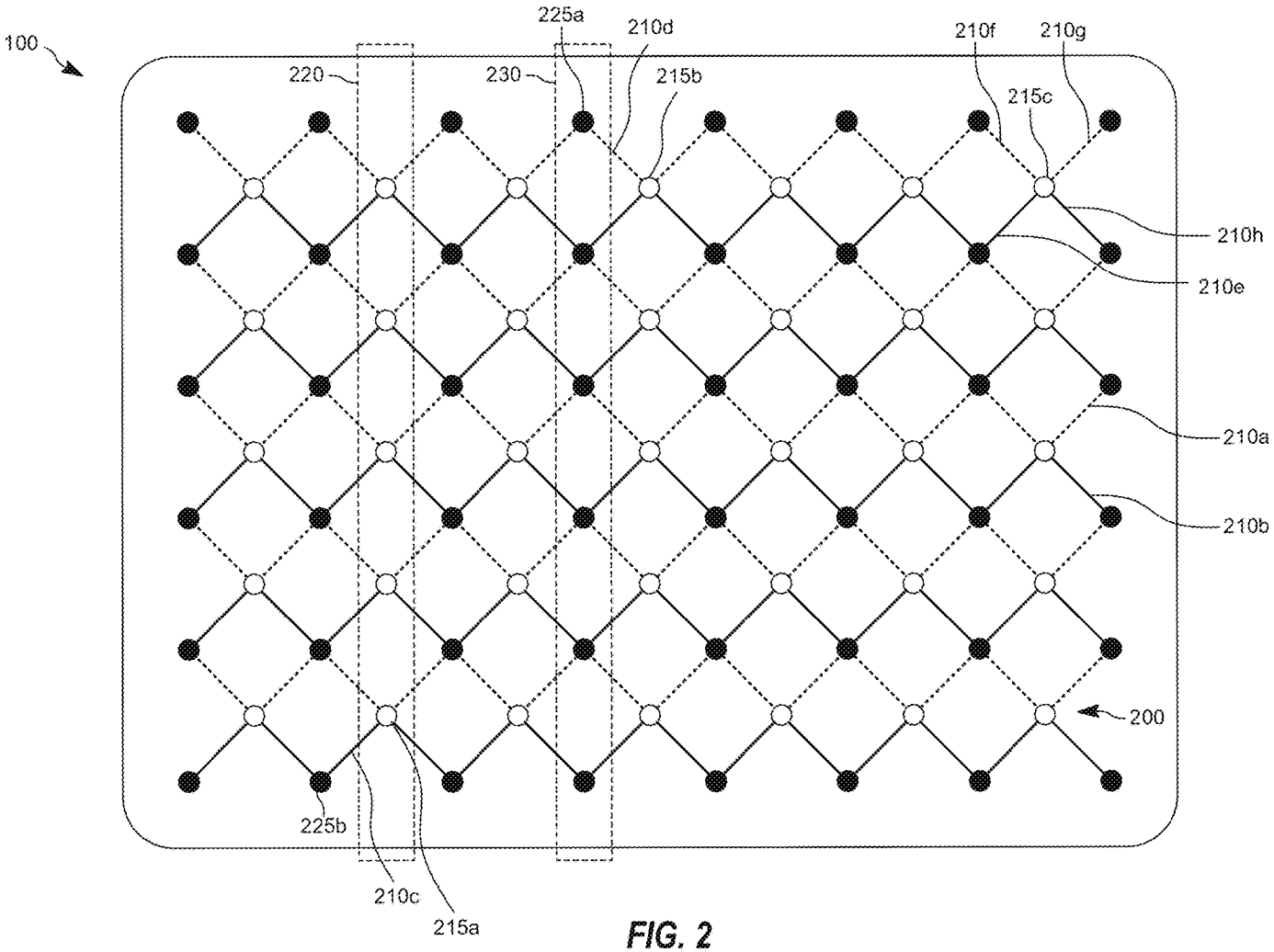
FIG. 2 is top view of an air mattress having a strip-based internal structure, in accordance an example embodiment of with the presently disclosed subject matter.

FIG. 2 is a top view of an embodiment of an air mattress 100 comprising an internal structure 200. As discussed, in some embodiments, an internal structure 200 of an air mattress 100 may be included in the interior of the air mattress 100. The internal structure 200 may help the air mattress 100 achieve and maintain its intended shape once the air mattress 100 is inflated. Further, an internal structure 200 may prevent the air mattress 100 from over-inflating. Similarly, the internal structure 200 may prevent the top surface (e.g., top surface 110) and the bottom surface (e.g., bottom surface 115) from shearing (i.e., moving laterally relative to each other).

In some embodiments, an internal structure 200 may comprise a plurality of connection strips 210 (e.g., strips 210*a*, 210*b*) having a predetermined length that are attached (i.e., joined, connected, affixed) to one or more of the top surface 110 and bottom surface 115 of the air mattress 100. In some embodiments, a connection strip 210 may be constructed from PVC or various other fiber, fabric, or film that is suitable for a particular application. In some embodiments, a connection strip 210 may be constructed from a single piece of material (e.g., the connection strip 210 may be a single, continuous strip of PVC). In some embodiments, a connection strip 210 may be constructed from a collection (i.e., a plurality) of materials, fibers, or strings.

As shown in FIG. 2, in some embodiments, the air mattress 100 can be transparent, thereby providing a view of the plurality of connection strips 210 (e.g., connection strips 210*a*, 210*b*) comprising the internal structure 200. Further, the transparency of the air mattress 100 provides a view of top surface connection points 215, as highlighted by dashed box 220, which includes top surface connection point 215*a*. Further, the transparency of the air mattress 100 provides a view of bottom surface connection points 225, as highlighted by dashed box 230, which includes bottom surface connection point 225*a*. In some embodiments, connection points (e.g., top surface connection points 215 and bottom surface connection points 225) are on opposing interior surfaces of the top surface 110 and bottom surface 115. Accordingly, in such embodiments, the connection points are on the interior of the air mattress 100. Further, in some embodiments, connection strips 210 may attach directly to connection points 215 and 225. In some embodiments, for example, a connection strip 210 may be welded to top and bottom surface attachment points 215, 225. Further, in some embodiments, a connection strip 210 may be glued, sewn, adhered, or otherwise attached to top and bottom surface attachment points 215, 225.

As shown in FIG. 2, in some embodiments, a connection strip 210 may attach between a top surface connection point 215 and a bottom surface connection point 225. In some embodiments, when an air mattress 100 is inflated, as shown in FIG. 2, a connection strip 210 may angle from top surface 110 toward bottom surface 115, or vice versa. For example, as shown in FIG. 2, connection strip 210*c* angles from bottom surface connection point 225*b* toward top surface connection point 215*a*. Similarly, as shown in FIG. 2, connection strip 210*d* angles from bottom surface connection point 225*a* toward top surface connection point 215*b*, according to some embodiments. As will be appreciated, when configured in the manner described and shown in FIG. 2, angled connection strips (e.g., connection strip 210*c* and 210*d*) may comprise an internal structure 200 with sufficient strength to prevent the air mattress 100 from over-inflating and to prevent the top surface and bottom surface (e.g., 110 and 115) from moving laterally in relation to one another (i.e., shearing).

Further, in some embodiments, a plurality of connection strips 210 may connect to a particular top surface connection point 215 or bottom surface connection point 225. For example, in some embodiments and as shown in FIG. 2, four connection strips 210*e-h* attach to a single connection point (i.e., top surface connection point 215*c*). It is contemplated that in various embodiments, any number of connection strips 210 could connect to a particular connection point (e.g., a top surface connection point 215 or bottom surface connection point 225. As shown in FIG. 2, in configurations in which multiple connection strips (e.g., 210*e-h*) attach to a single connection point (e.g., top surface connection point 215*c*), and in which the connection strips 210 angle from a top surface connection points 215 toward bottom surface connection points 225, and vice versa, the plurality of connection strips 210 may constitute an internal structure 200 having a web-like configuration. According to some embodiments, a plurality of top surface connection points 215 may be spaced apart at predetermined distances or intervals, and a plurality of bottom surface connection points may also be spaced apart at predetermined distances or intervals. In some embodiments, a plurality of bottom surface connection points 225 may be located on the bottom surface 115 in positions that are offset relative to the locations of the plurality of top surface connection points 215 on the top surface 110. As will be appreciated, an internal structure 200 having a web-like configuration may further aid in helping an air mattress 100 maintain its intended shape and prevent the air mattress 100 from becoming over-inflated. Further, an internal structure 200 having a web-like configuration may help prevent the top surface 110 and bottom surface 115 of an air mattress 100 from shearing or moving laterally relative to one another.

As noted above, in some embodiments, a connection strip 210 may be constructed from a single piece of material. But, in some embodiments, a connection strip 210 may comprise a plurality of individual strips or strands. In some embodiments, each of the plurality of individual strips that comprise a connection strip may attach to the same top surface connection point 215 and bottom surface connection point 225. In some embodiments, however, a connection strip 210 may comprise attachment strips (or, alternatively, weld strips) at each end of the connection strip 210. An attachment strip may be a strip of material or a patch, that may be used to affix a portion of an internal structure 200 to a portion of the air mattress 100. For example, an attachment strip may be a strip of PVC that may be welded to a surface of the air mattress 100. In some embodiments, a portion of an internal structure 200, for example, a portion of a connection strip 210, may be sandwiched between an attachment strip and a surface of the air mattress 100 and the attachment strip may be welded to the surface of the air mattress 100 to secure the connection strip 210 to it. In such embodiments, the plurality of individual strips or strands comprising the connection strip 210 may be held in place by the opposing attachment strips, and the attachment strips may be affixed to the top and bottom surface connection points (i.e., 215 and 225). For example, in some embodiments, an attachment strip, a portion of a connection strip 210, and a portion of either the top surface 110 or bottom surface 115 may be welded together at a top surface connection point 215 or bottom surface connection point 225.

Figure 3A:
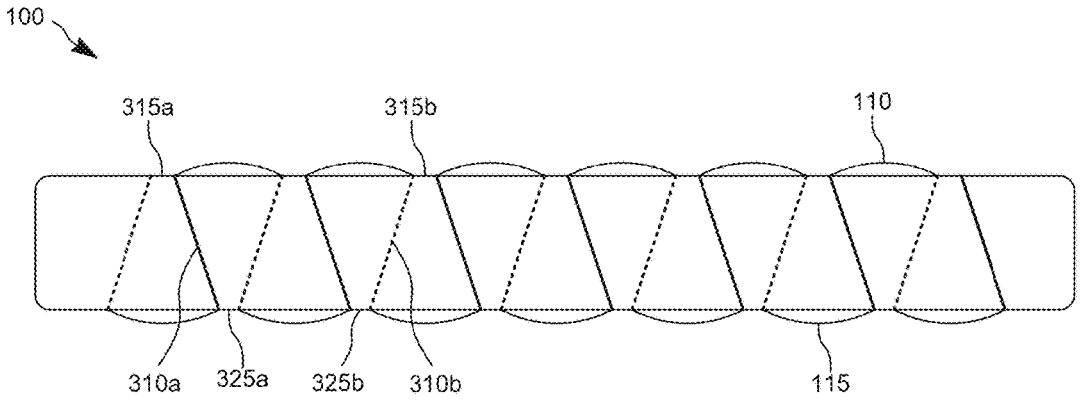
FIG. 3A is a side view of an air mattress having a strip-based internal structure, in accordance with an example embodiment of the presently disclosed subject matter.

FIG. 3A is a side view of an air mattress 100, according to some embodiments. As shown in FIG. 3A, a top surface 110 may comprise a plurality of top surface connection points 315*a*, 315*b* as well as a plurality of bottom surface connection points 325*a*, 325*b*. In some embodiments, a connection strip (e.g., connection strip 315*a*) may connect at two connection points (e.g., top surface connection point 315*a* and bottom surface connection point 325*a*). As shown in FIG. 3A, in some embodiments, a connection strip 310*a* may angle from a top surface connection point (e.g., 315*a*) toward a bottom surface connection point (e.g., 325*a*). Similarly, in some embodiments, a connection strip 310*b* may angle from a bottom surface connection point 325*b* toward a top surface connection point 315*b*. As will be appreciated, such a configuration of connection strips (e.g., 310*a*, 310*b*) creates a web-like internal structure 200, which may help prevent the top surface 110 and bottom surface 115 of the mattress 100 from shearing.

Figure 3B:
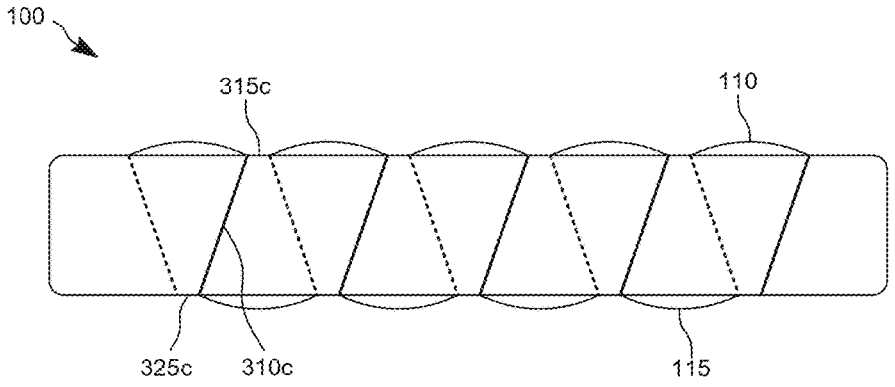
FIG. 3B is an end view of an air mattress having a strip-based internal structure, in accordance with an example embodiment of the presently disclosed subject matter.

Similarly, FIG. 3B is an end view of an air mattress 100, according to some embodiments. As shown in FIG. 3B, in some embodiments, a top surface 110 may comprise a plurality of top surface connection points (e.g., 315*c*), and a bottom surface 115 may comprise a plurality of bottom surface connection points (e.g., 325*c*), and connection strips (e.g., 310*c*) may be attached therebetween.

Figure 4:
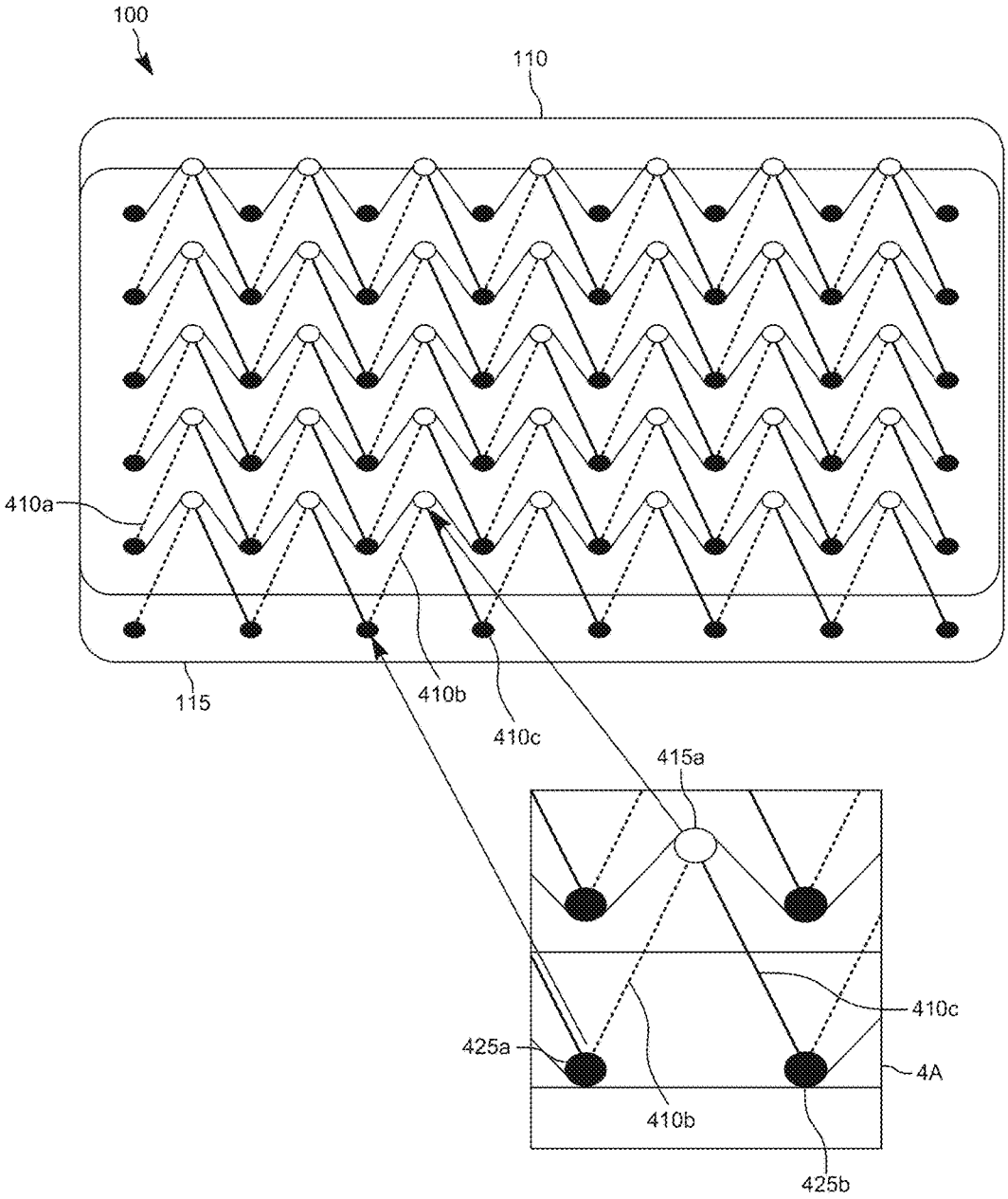
FIG. 4 is a perspective view of an air mattress having a strip-based internal structure including a detail view of a strip-based internal structure, in accordance with an example embodiment of the presently disclosed subject matter.

FIG. 4 is a perspective view of an air mattress 100, according to some embodiments. As shown in FIG. 4, the air mattress 100 is transparent (as in FIG. 2), thereby providing a view of the plurality of connection strips (e.g., 410*a*, 410*b*, 410*c*) comprising the internal structure. Further, FIG. 4 includes a close-up view 4A of various components of the internal structure, according to some embodiments. For example, close-up view 4A highlights top surface connection point 415*a* and bottom surface connection points 425*a* and 425*b*. Further, close-up view 4A highlights connection strip 410*b*, which is attached to top surface connection point 415*a* and bottom surface connection point 425*a*. Further, close-up view 4A highlights connection strip 410*c*, which is attached to top surface connection point 415*a* and bottom surface connection point 425*b*. As shown in FIG. 4, in some embodiments, one or more connections strips 410 may be configured to extend from a top surface connection point 415 to a bottom surface connection point 425 at a non-right angle. Further, a plurality of connection strips 410 may extend out of each of the top surface connection points 415 and bottom surface connection points 425 to the opposing surface. For example, a connection point may have two, three, four, or more connection strips 410 extending away from it. According to some embodiments, each of these connection strips 410 may extend and connect to a different connection point on the opposing surface. The opposing surface of the top surface connection points 415 may be the bottom surface 115 and the opposing surface of the bottom surface connection points 425 may be the top surface 110. According to some embodiments, where a connection point has a plurality of connection strips 410 extending out of it, the plurality of connection strips may be configured to extend away from the connection point such that they are approximately equidistant from each adjacent connection strip 410 when the mattress is inflated.

Figure 5:
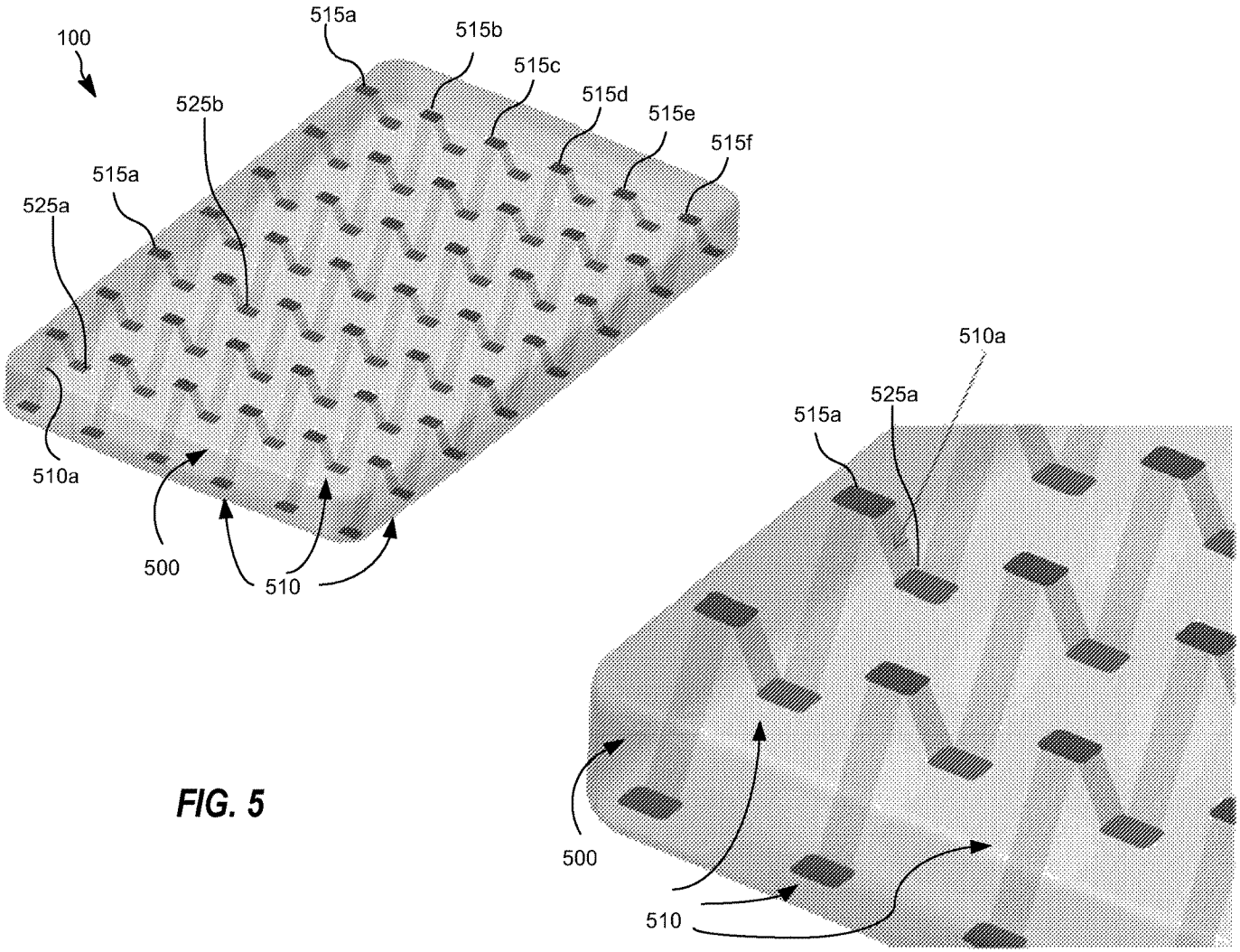
FIG. 5 is a perspective view of an air mattress having a strip-based internal structure including a detail view of a strip-based internal structure, in accordance with an example embodiment of the presently disclosed subject matter.

FIG. 5 is a perspective view of an air mattress 100 comprising an internal structure 500. In some embodiments, an internal structure 500 of an air mattress 100 may be included in the interior of the air mattress 100 and may operate in a manner similar to internal structure 200 described above. For example, the internal structure 500 may help the air mattress 100 achieve and maintain its intended shape once the air mattress 100 is inflated. Further, internal structure 500 may prevent the air mattress from over-inflating. Similarly, the internal structure 500 may prevent the top surface (e.g., top surface 110) and the bottom surface (e.g., bottom surface 115) from shearing (i.e., moving laterally relative to each other).

In some embodiments, an internal structure 500 may comprise a plurality of connection strips 510 having a predetermined length that are attached (i.e., joined, connected, affixed) to one or more of the top surface 110 and bottom surface 115 of the air mattress 100. In some embodiments, a connection strip 510 may be constructed from PVC or various other fiber, fabric, or film that is suitable for a particular application. In some embodiments, a connection strip 510 may be mesh, thread, or an equivalent material. A connection strip 510 may be constructed from a single piece of material (e.g., the connection strip 510 may be a single, continuous strip of PVC, mesh, thread, or an equivalent material), or a connection strip 510 may be constructed from a collection (i.e., a plurality) of materials, fibers, or strings. According to some embodiments, a connection strip 510 may be attached to the top surface 110 and/or bottom surface 115 at the top surface connection point 515 and/or bottom surface connection point 525, respectively, by positioning the top surface connection point 515 and/or bottom surface connection point 525 between an internal surface of air mattress 100 and a PVC strip and welding them together.

As described above, in some embodiments, the air mattress 100 can be transparent, thereby providing a view of the plurality of connection strips 510 comprising internal structure 500. Further, the transparency of the air mattress 100 provides a view of top surface connection points 515, which includes top surface connection point 515*a*. Further, the transparency of the air mattress 100 provides a view of bottom surface connection points 525, which includes bottom surface connection point 525*a*. In some embodiments, connection points (e.g., top surface connection points 515 and bottom surface connection points 525) are on opposing interior surfaces of the top surface 110 and bottom surface 115. Accordingly, in such embodiments, the connection points are on the interior of the air mattress 100. Further, in some embodiments, connection strips 510 may attach directly to connection points 515 and 525. In some embodiments, for example, a connection strip 510 may be welded to top and bottom surface attachment points 515, 525. Further, in some embodiments, a connection strip 510 may be glued, sewn, adhered, or otherwise attached to top and bottom surface attachment points 515, 525.

As shown in FIG. 5, in some embodiments, a connection strip 510 may attach between a top surface connection point 515 (individual instances of top surface connection points are designated 515*a*, 515*b*, 515*c*, etc. in the FIGs.) and a bottom surface connection point 525 (individual instances of bottom surface connection points are designated 525*a*, 525*b*, etc. in the FIGs.). In some embodiments, when air mattress 100 is inflated, as shown in FIG. 5, a connection strip may angle from top surface 110 toward bottom surface 115, or vice versa, in a "zig-zag" fashion. For example, as shown in FIG. 5, connection strip 510*a* angles from the bottom surface connection point 525*a* toward top surface connection point 515*a*. As shown in FIG. 5, the connection strips 510 connecting bottom surface connection points 525 to top surface connection points 515 may be arranged in rows. For example, in the embodiment shown in FIG. 5, the internal structure 500 is made up of six rows of connection strips 510, wherein each row is indicated by top surface connection points 515*a*, 515*b*, 515*c*, 515*d*, 515*e*, and 515*f*, respectively. According to some embodiments, each row of connection strips 510 may be oriented to run parallel to the length of the air mattress 100. Alternatively, in some embodiments, each row of connection strips 510 may be oriented to run parallel to the width of the air mattress 100. And as a further alternative, rows of connection strips 510 can run in both directions. Although FIG. 5 shows six rows of connection strips 510, it will be understood that an internal structure 500 may be comprised of any number of rows of connection strips 510. As will be appreciated, when configured in the manner described and shown in FIG. 5, the rows of angled connection strips 510 may comprise an internal structure 500 that prevents the air mattress 100 from over-inflating and that prevents the top surface and bottom surface (e.g., 110 and 115) from moving laterally in relation to one another (i.e., shearing).

As noted above, in some embodiments, a connection strip 510 may be constructed from a single piece of material. But, in some embodiments, a connection strip 510 may comprise a plurality of individual strips or strands. In some embodiments, each of the plurality of individual strips that comprise a connection strip may attach to the same top surface connection point 515 and bottom surface connection point 525. In some embodiments, however, a connection strip 510 may comprise attachment strips (or, alternatively, weld strips) at each end of the connection strip 510. In such embodiments, the plurality of individual strips or strands comprising the connection strip 510 may be held in place by the opposing attachment strips, and the attachment strips may be affixed to the top and bottom surface connection points (i.e., 515 and 525).

Figure 6:
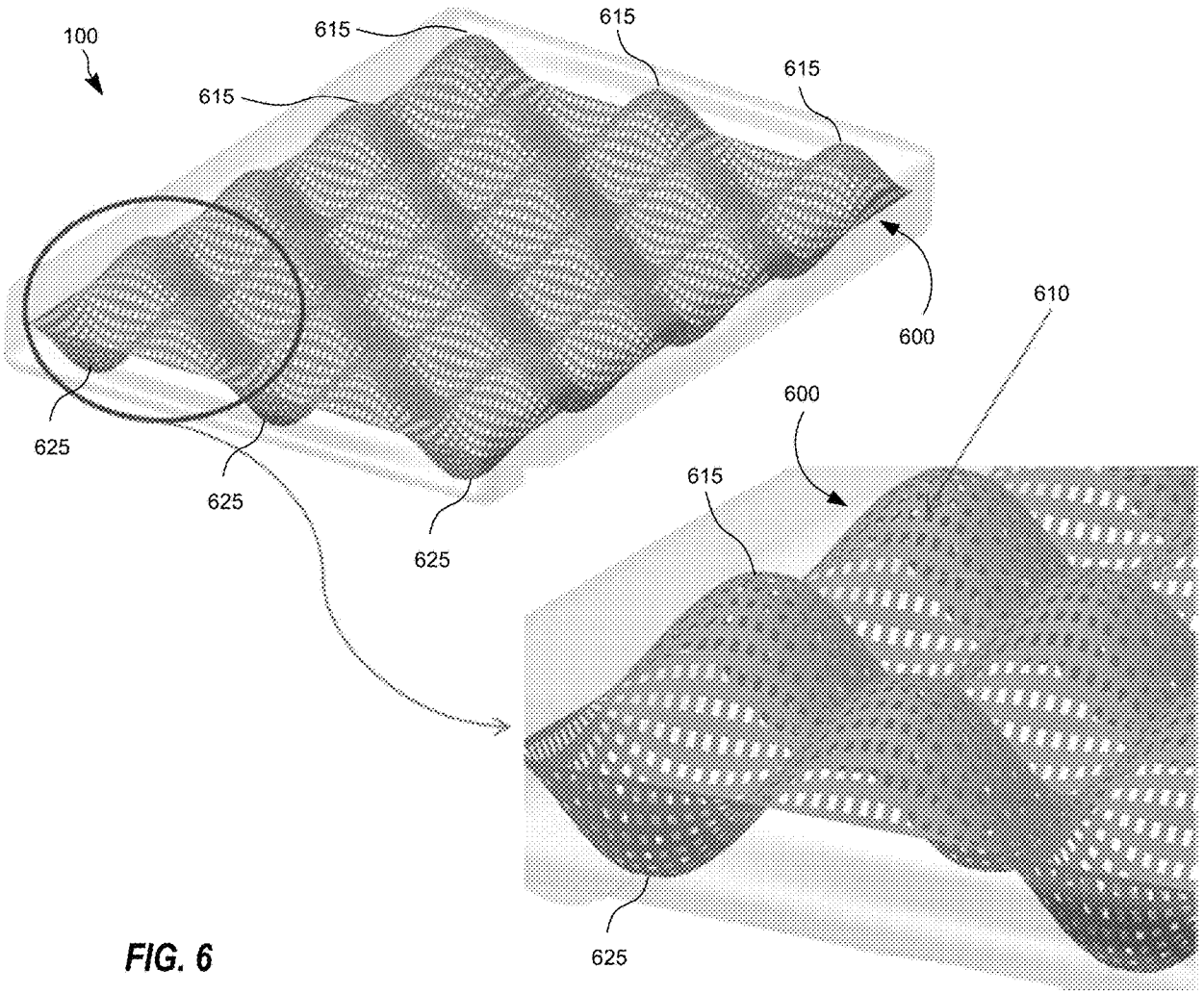
FIG. 6 is a perspective view of an air mattress having a mesh-based internal structure including a detail view of a mesh-based internal structure, in accordance with an example embodiment of the presently disclosed subject matter.

FIG. 6 is a perspective view of an air mattress 100 comprising an internal structure 700 that is comprised of a single sheet of material. According to some embodiments, the internal structure 600 may be a continuous piece of material. In some embodiments, the internal structure may be a mesh structure 610 (which may also be referred to as a "mesh web" or a "mesh sheet") that includes one or more apertures forming a mesh. In some embodiments, a mesh structure 610 may be made of a single piece of material including a plurality of apertures. In some embodiments, an internal structure 600 of an air mattress 100 may be included in the interior of the air mattress 100 and may operate in a manner similar to internal structures 200, 500 described above. For example, the internal structure 600 may help the air mattress 100 achieve and maintain its intended shape once the air mattress 100 is inflated. Further, internal structure 600 may prevent the air mattress from over-inflating. Similarly, the internal mesh structure 600 may prevent the top surface (e.g., top surface 110) and the bottom surface (e.g., bottom surface 115) from shearing (i.e., moving laterally relative to each other). In some embodiments, the outer edge of the internal structure 600 may be attached to the inner surfaces of the side surfaces 120.

In some embodiments, a mesh structure 610 may be constructed from PVC or various other fiber, fabric, or film that is suitable for a particular application. In some embodiments, a mesh structure 610 may be constructed form a single piece of material (e.g., the mesh structure 610 may be a single, continuous piece of fiber). In some embodiments, a mesh structure 610 may be constructed from a collection (i.e., plurality) of materials, fibers, or strings.

As shown in FIG. 6, in some embodiments, a mesh structure 610 may attach to the internal surface of an air mattress 100 at various top surface connection points 615 and bottom surface connection points 625. According to some embodiments, the top surface connection points 615 and bottom surface connection points 625 may be located in positions similar to those shown with respect to internal structure 200 and creating a 3D web-like structure as previously described above. For example, according to some embodiments, a plurality of top surface connection points 615 may be spaced apart at predetermined distances or intervals, and a plurality of bottom surface connection points may also be spaced apart at predetermined distances or intervals. In some embodiments, a plurality of bottom surface connection points 625 may be located on the bottom surface 115 in positions that are offset relative to the locations of the plurality of top surface connection points 615 on the top surface 110. Accordingly, in some embodiments, when air mattress 100 is inflated, the mesh structure 610 may take on a 3-dimensional, approximately sinusoidal shape with top and bottom "humps" extending in upwards and/or downwards directions when the airbed is inflated, as shown in FIG. 6. According to some embodiments, the peak of each top hump may attach to the air mattress 100 at a top connection point 615 and the trough of each bottom hump may attach to the air mattress 100 at a bottom connection point 625. As will be appreciated, an internal structure 600 having a web-like configuration may help prevent the top surface 110 and bottom surface 115 of an air mattress 100 from shearing and moving laterally relative to one another.

Figure 7:
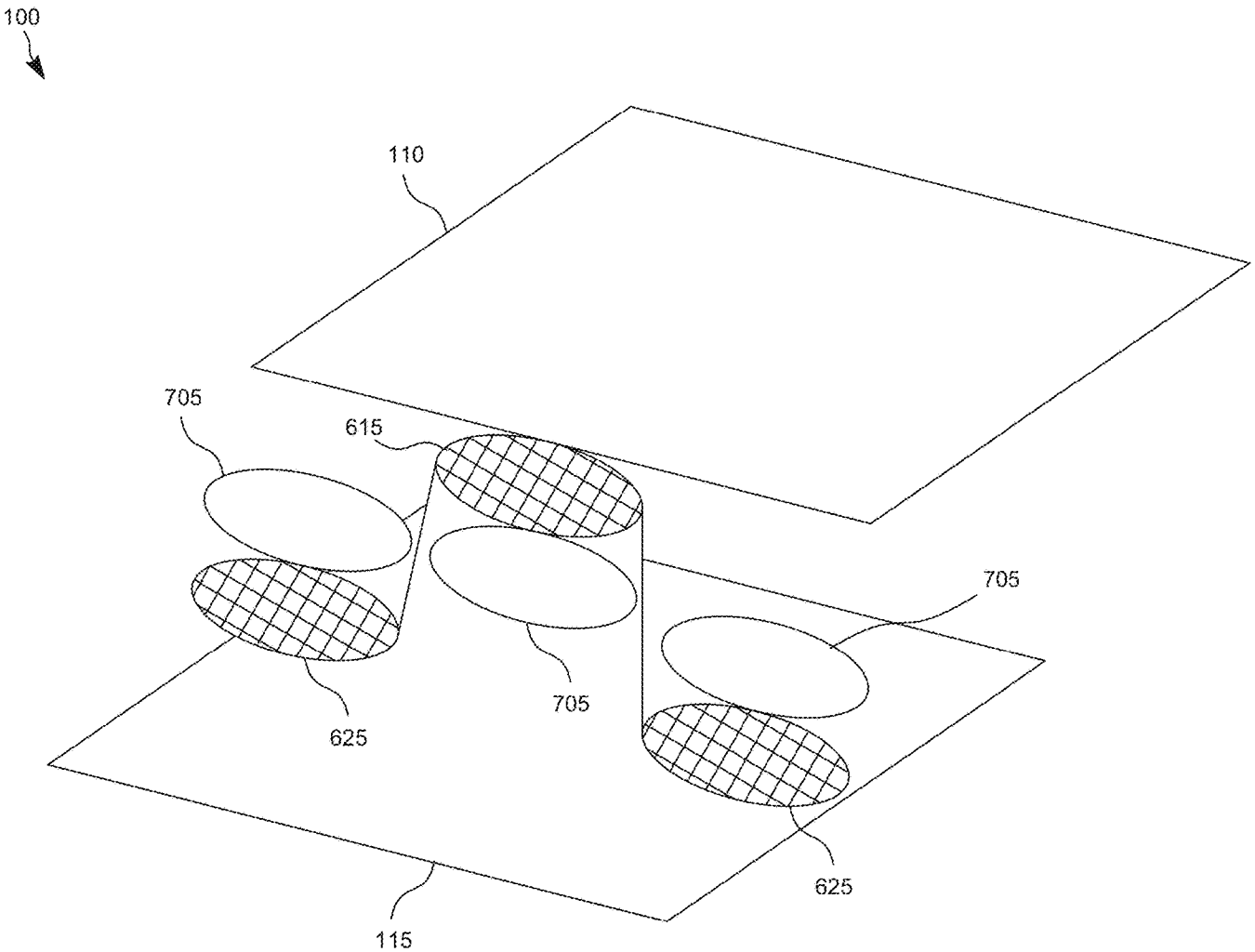
FIG. 7 is a perspective view of an internal portion of an air mattress having a mesh-based internal structure, showing attachment of the mesh-based internal structure to the outer walls of the air mattress in accordance with an example embodiment of the presently disclosed subject matter.

As described above, a mesh structure 610 may attach (i.e., join, connect, affix) to the top surface 110 and bottom surface 115 of the air mattress 100. In some embodiments, a mesh structure 610 may attach to the air mattress 100 at one or more top surface connection points 615 and one or more bottom surface connection points 625. In some embodiments, portions of a mesh structure 610 may be welded to top and bottom surface attachment points 615, 625. In some embodiments, portions of the mesh structure 610 may be attached to the air mattress 100 with one or more attachment strips. For example, in some embodiments, an attachment strip may be used to secure a portion of a mesh structure 610 to a top surface connection point 615 or a bottom surface connection point 625. As shown in FIG. 7, according to some embodiments, portions of the mesh structure 610 may be attached to the air mattress 100 with one or more attachment strips 705. For example, a top connection point 615 may be sandwiched between an attachment strip 705 and the top surface 110 and the three may be welded together. Likewise, a bottom surface connection point 625 may be sandwiched between an attachment strip 705 and the bottom surface 115 and the three may be welded together. According to some embodiments, an attachment strip 705 may be a PVC strip. Further, in some embodiments, a mesh structure 610 may be glued, sewn, adhered, or otherwise attached to top and bottom surface attachment points 615, 625.

Figure 8:
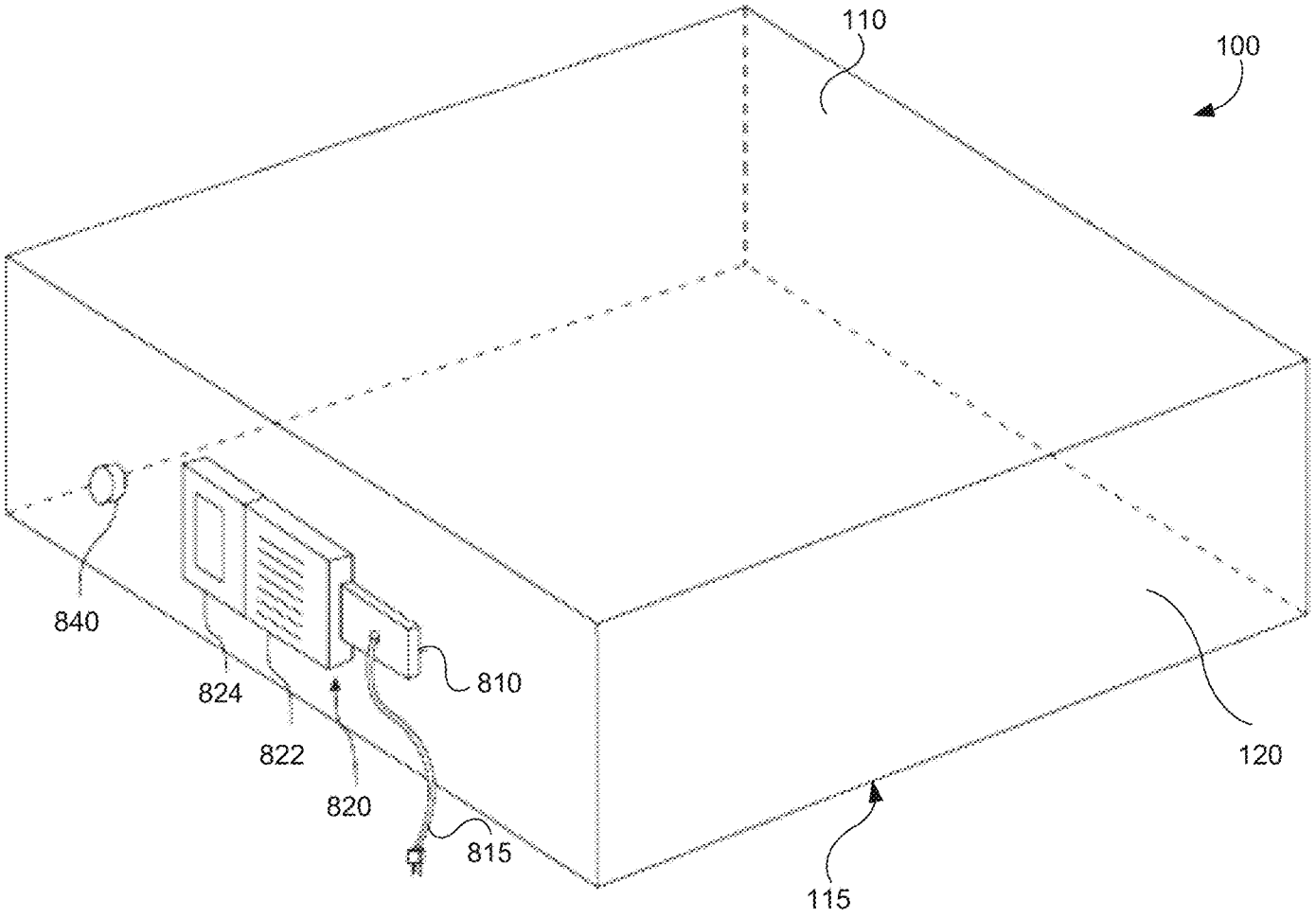
FIG. 8 is a schematic overview of an air mattress comprising various air mattress components, in accordance with an example embodiment of the presently disclosed subject matter.

FIG. 8 is an embodiment of an air mattress 100 comprising a top surface 110, bottom surface 115, a plurality of side surfaces (e.g., side surface 120), and various air mattress 100 components. Further, as shown in FIG. 8, in some embodiments, an air mattress 100 may comprise a portable power source 810. In some embodiments, a portable power source 810 may be a battery and provide direct current. In other embodiments, portable power source 810 may include a motor or generator and provide alternating current. It is contemplated that any portable power source may be used. Further, a portable power source 810 may be housed in a power source housing (not shown) on air mattress 100 for convenient transport. In some embodiments, a portable power source 810 may comprise a power plug 815, which may be attachable to portable power source 810. In some embodiments, however, power plug 815 may be used in lieu of portable power source 810. Power plug 815 may include a variety of power plugs, such as those configured to plug into USB ports and 120V standard outlets. As will be appreciated, while a portable power source 810 may be used in outdoor and indoor locations, a power plug 815 may be suited for indoor use when air mattress 100 is placed near an electrical outlet.

In some embodiments, an air mattress may comprise an air control system 820, which may be used to control air flow and to inflate and deflate an air mattress 100. In some embodiments, a portable power source 810 or a power plug 815 (or a combination of both) may provide power to an air control system 820. In some embodiments, an air control system 820 may include an air intake component 822 and a controller 824. An air intake component 822 may be configured to direct ambient air into the air mattress 100 during mattress inflation and direct air from the air mattress 100 during mattress deflation. In some embodiments, the air intake component 822 may comprise an outer seal that inhibits or allows the flow of outside air into the air control system 820. In some embodiments, the air intake component 822 also may include an inner seal (not shown) that inhibits or allows the flow of internal air between air control system 820 and the air chamber (i.e., interior) of an air mattress 100.

In some embodiments, a controller 824 may be configured to receive user input and control the opening or closing of inner and outer seals and/or inflating and deflating of the air mattress 100 via the air control system 820. In some embodiments, the controller 824 may include one or more processors having memory. Also, in some embodiments, the controller 824 may be configured to execute one or more operating modes. For example, operating modes may include inflation mode, deflation mode, air recirculation mode, and standby mode. In some embodiments, the controller 824 may include one or more electronic components that allow a user to switch between modes.

In some embodiments, inflation mode may begin when the controller 824 receives user input to inflate the air mattress 100. In some embodiments, inflation mode may last until the controller 824 receives additional user input to stop inflating the air mattress 100. In some embodiments, however, the controller 824 may automatically control the speed and duration of inflation based on a predetermined or user supplied air pressure for the air in the air mattress 100. During inflation mode, both the inner and outer seals may be open to allow ambient air to flow into the air mattress 100.

In some embodiments, deflation mode may begin when the controller 824 receives user input to deflate the air mattress 100. For example, in some embodiments, deflation mode may last until the controller 824 receives additional user input to stop deflating the air mattress 100. Further, in some embodiments, the controller 824 may automatically control the speed and duration of deflation based on a predetermined or user supplied air pressure for the air in the air mattress 100. During deflation mode, both the inner and outer seals may be open to allow ambient air to flow out of the air mattress 100.

According to some embodiments, an air recirculation mode may begin when the controller 824 receives user input to circulate air within air mattress 100. In doing so, the controller 824 may direct the outer seal to close while the inner seal remains open, thus allowing air to enter the air intake component 822, but not escape the air mattress 100. According to some embodiments, circulating air within an air mattress 100 may cause a vibrating or massaging pulse on the surface of the air mattress 100 and/or adjust air pressure via air control system 820. In some embodiments, air recirculation mode may last until the controller 824 receives additional user input to stop circulating air within the air mattress 100. Also, in some embodiments, the controller 824 may automatically control the time duration and/or interval to recirculate air within the air mattress 100.

In some embodiments, a standby mode may occur when the controller 824 receives power from portable power source 810 and/or power plug 815 and is not placed in another mode. For example, the controller 824 may operate in standby mode before receiving user input. In some embodiments, the controller 824 may also direct the inner seal to close to inhibit air recirculation. Also, in some embodiments, the controller 824 may direct the inner seal to remain open. It is contemplated that the air mattress 100 may only include the outer seal and not the inner seal, according to some embodiments.

In some embodiments, an air mattress 100 may comprise an air release valve 840. According to some embodiments, an air release valve 840 may be configured to inhibit the flow of air out of the air mattress 100 when the air release valve 840 is in a closed position and allow air flow out of air mattress 100 when the air release valve 840 is in an open position. In some embodiments, an air release valve 840 may move from the closed position to an open position when the air pressure inside an air mattress 100 exceeds a predetermined threshold. In such embodiments, the air release valve 840 may serve as a safety valve to prevent damage to the air mattress 100 from over-inflation. In some embodiments, an air release valve 840 may comprise a removable plug that may be removed when a user desires to deflate the air mattress 100. In some embodiments, an air release valve 840 may be constructed out of polyvinyl chloride ("PVC"). It is contemplated, however, that other materials such as plastics or rubber may be used.

While the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. But, other equivalent methods or composition to these described aspects are also contemplated by the teachings herein. Therefore, the present disclosure should not be limited to any single aspect, but rather construed in breadth and scope in accordance with the appended claims.

What is claimed is:

1. An inflatable air mattress comprising:

a top surface having a plurality of top surface connection points;

a bottom surface having a plurality of bottom surface connection points;

one or more side surfaces connecting the top surface to the bottom surface such that the top surface, bottom surface, and side surfaces form an airtight enclosure that comprises the exterior of the inflatable air mattress; and a mesh structure attached to an internal surface of the inflatable air mattress at the top surface connection points and bottom surface connection points, wherein the top surface connection points and bottom surface connection points are positioned such that the mesh structure has a three-dimensional approximately sinusoidal shape when the inflatable air mattress is inflated.

2. The inflatable air mattress of claim 1, wherein the top surface connection points and bottom surface connection points are positioned to be offset in location relative to each other when the inflatable air mattress is inflated.

3. The inflatable air mattress of claim 1, wherein the three-dimensional approximately sinusoidal shape is formed with top and bottom humps extending in upwards or downward directions when the inflatable air mattress is inflated.

4. The inflatable air mattress of claim 3, wherein each top hump's peak is attached to the inflatable air mattress at a top surface connection point and each bottom hump's trough is attached to the inflatable air mattress at a bottom surface connection point.

5. The inflatable air mattress of claim 1, wherein the top surface connection points are located on the top surface's bottom side and the bottom surface connection points are located on the bottom surface's top side.

6. The inflatable air mattress of claim 1, wherein the mesh structure comprises a single piece of material including a plurality of apertures.

7. An inflatable air mattress comprising:

a top surface having a plurality of top surface connection points;

a bottom surface having a plurality of bottom surface connection points;

one or more side surfaces connecting the top surface to the bottom surface such that the top surface, bottom surface, and side surfaces form an airtight enclosure that comprises the exterior of the inflatable air mattress; and a plurality of connection strips, each connection strip attached to (i) one top surface connection point and two bottom surface connection points or (ii) two top surface connection points and one bottom surface connection point, and wherein at least some of the connection strips extend at a non-right angle between top surface connection points and bottom surface connection points to create a web-like internal structure.

8. The inflatable air mattress of claim 7, wherein the at least some of the connection strips extending at a non-right angle between top surface connection points and bottom surface connection points comprise a plurality of angled connection strips arranged in rows.

9. The inflatable air mattress of claim 7, wherein the top surface connection points are located on the top surface's bottom side and the bottom surface connection points are located on the bottom surface's top side.

10. The inflatable air mattress of claim 7, wherein at least one of the connection strips comprises an attachment strip at each end thereof, the attachment strip being configured to secure the connection strip to a top surface connection point and bottom surface connection point.

11. The inflatable air mattress of claim 10, wherein an attachment strip, a portion of a connection strip, and a portion of the top surface or bottom surface are welded together.

12. The inflatable air mattress of claim 7, wherein at least one connection point of the plurality of top surface connection points or at least one connection point of the plurality of bottom surface connection points has a group of connection strips of the plurality of connection strips extending away from the at least one connection point towards an opposing surface.

13. The inflatable air mattress of claim 12, wherein each of the connection strips of the group of connection strips extends away from the connection point and connects to a different connection point on the opposing surface.

14. The inflatable air mattress of claim 7, wherein the plurality of top surface connection points and the plurality of bottom surface connection points are spaced apart at predetermined intervals.

15. The inflatable air mattress of claim 7, wherein the plurality of bottom surface connection points are located on the bottom surface in positions that are offset relative to locations of the plurality of the top surface connection points on the top surface.

16. The inflatable air mattress of claim 7, wherein at least some of the plurality of connection strips are aligned in one or more rows that are parallel to a side surface upon inflation of the inflatable air mattress.

17. The inflatable air mattress of claim 7, wherein at least some of the plurality of connection strips are parallel to the length of the inflatable air mattress.

18. The inflatable air mattress of claim 7, wherein at least some of the plurality of connection strips are parallel to the width of the inflatable air mattress.

19. The inflatable air mattress of claim 7, wherein the plurality of connection strips are constructed from a single piece of material.

* * * * *